US009766016B2

(12) United States Patent
Dupont

(10) Patent No.: US 9,766,016 B2
(45) Date of Patent: Sep. 19, 2017

(54) HEAT TRANSFER DEVICE USING CAPILLARY PUMPING

(75) Inventor: Vincent Dupont, Etterbeek (BE)

(73) Assignee: EURO HEAT PIPES, Nivelles (BE)

( * ) Notice: Subject to any disclaimer, the term of this patent is extended or adjusted under 35 U.S.C. 154(b) by 374 days.

(21) Appl. No.: 14/344,883

(22) PCT Filed: Sep. 12, 2012

(86) PCT No.: PCT/EP2012/067753
§ 371 (c)(1),
(2), (4) Date: Oct. 27, 2014

(87) PCT Pub. No.: WO2013/037785
PCT Pub. Date: Mar. 21, 2013

(65) Prior Publication Data

US 2015/0114605 A1 Apr. 30, 2015

(30) Foreign Application Priority Data

Sep. 14, 2011 (FR) ..... 11 58203

(51) Int. Cl.
*F28D 15/00* (2006.01)
*F28D 15/04* (2006.01)
*F28D 15/06* (2006.01)

(52) U.S. Cl.
CPC ..... *F28D 15/043* (2013.01); *F28D 15/06* (2013.01)

(58) Field of Classification Search
CPC ..... F28D 15/05; F28D 15/043; F28D 15/046
USPC ..... 165/104.19, 104.21, 104.26
See application file for complete search history.

(56) References Cited

U.S. PATENT DOCUMENTS 2,366,955 A * 1/1945 Burggrabe ..... F25B 25/005 165/104.21
4,061,131 A * 12/1977 Bohanon ..... F24J 2/4649 126/590
4,792,283 A * 12/1988 Okayasu ..... F04F 1/04 417/209
4,830,097 A 5/1989 Tanzer
(Continued)

FOREIGN PATENT DOCUMENTS

FR 2602851 A1 * 2/1988 ..... E03C 1/288
FR 2 949 642 A1 3/2011
(Continued)

OTHER PUBLICATIONS

FR 2602851 Translation.*

*Primary Examiner* — Len Tran
*Assistant Examiner* — Claire Rojohn, III
(74) *Attorney, Agent, or Firm* — Seed IP Law Group LLP

(57) ABSTRACT

A capillary-driven heat transfer device is adapted to extract heat from a heat source and release this heat to a cold source using a two-phase working fluid. The device includes an evaporator having a microporous mass performing capillary pumping of fluid in the liquid phase, a condenser, a reservoir having an inner chamber and an inlet and/or outlet port, a vapor communication circuit, connecting the outlet of the evaporator to the inlet of the condenser, a liquid communication circuit, and a non-return device arranged between the inner chamber of the reservoir and the microporous mass of the evaporator, and arranged to prevent liquid present in the evaporator from moving to the inner chamber of the reservoir.

10 Claims, 4 Drawing Sheets

(56) References Cited

Figure 1:
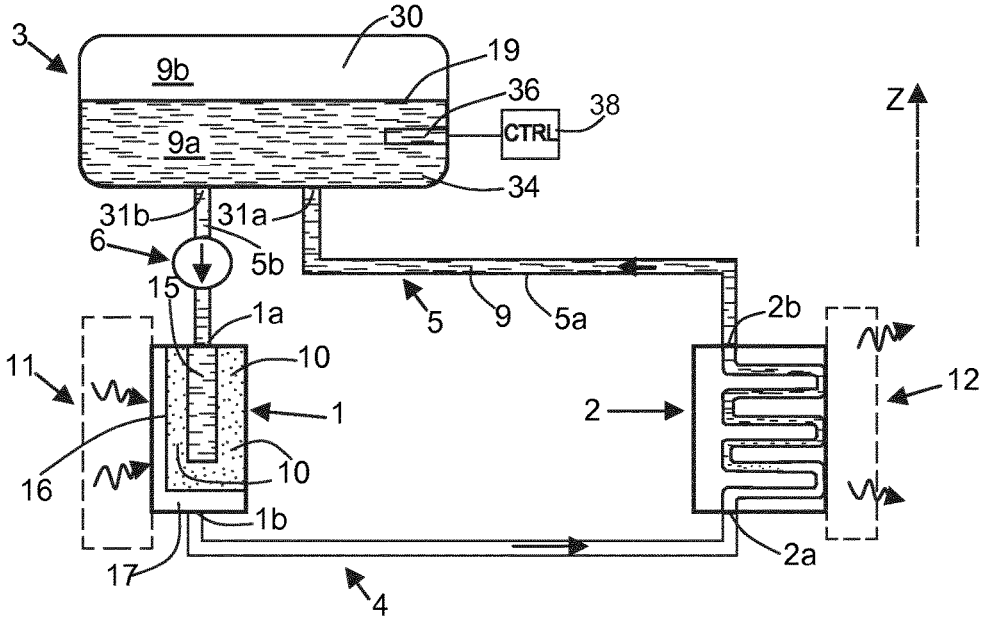

U.S. PATENT DOCUMENTS 4,957,157 A 9/1990 Dowdy et al.
4,986,348 A * 1/1991 Okayasu ..... F28D 15/06 165/104.22
5,203,399 A * 4/1993 Koizumi ..... F25B 23/006 165/104.22
5,816,313 A * 10/1998 Baker ..... F16K 15/048 137/519.5
5,881,801 A * 3/1999 Hayakawa ..... F02G 1/00 165/104.24
7,549,461 B2 * 6/2009 Kroliczek ..... F25B 23/006 165/104.21
7,980,294 B2 * 7/2011 Ohashi ..... F28D 15/0266 165/104.24
8,047,268 B1 * 11/2011 Kroliczek ..... F28D 15/043 165/104.21
8,136,580 B2 * 3/2012 Kroliczek ..... F25B 23/006 165/104.21
8,627,847 B2 * 1/2014 Montague ..... E03B 9/16 137/300
2003/0145622 A1 8/2003 Kawasaki et al.
2005/0067146 A1 * 3/2005 Thayer ..... F25B 23/006 165/80.3
2006/0065386 A1 * 3/2006 Alam ..... G06F 1/20 165/104.33
2010/0101762 A1 * 4/2010 Kroliczek ..... F28D 15/043 165/104.26
2011/0192575 A1 * 8/2011 Figus ..... F28D 15/043 165/104.26
2012/0291989 A1 * 11/2012 Fong ..... F01K 25/06 165/45

FOREIGN PATENT DOCUMENTS

GB 1 402 509 8/1975
JP 61-175483 A 8/1986

* cited by examiner

HEAT TRANSFER DEVICE USING CAPILLARY PUMPING

The present invention relates to capillary-driven heat transfer devices, in particular two-phase fluid loop passive devices.

It is known from document FR-A-2949642 that such devices are used as a means to cool electrotechnical power converters.

However, it has appeared that the startup phases were especially subject to problems in the presence of high thermal power levels, drying-out of the capillary wick may occur resulting in startup failure.

There therefore appeared a need to increase the reliability of the startup and operation of such loops.

To this end, the invention relates to a capillary-driven heat transfer device, adapted to extract heat from a heat source and to release this heat to a cold source by means of a two-phase working fluid contained in a closed general circuit, comprising:

at least one evaporator, having an inlet and an outlet, and a microporous mass adapted to perform capillary pumping of fluid in the liquid phase at least one condenser, having an inlet and an outlet, a reservoir having an inner chamber and at least one inlet and/or outlet port, a first communication circuit, for fluid mainly in the vapor phase, connecting the outlet of the evaporator to the inlet of the condenser, a second communication circuit, for fluid mainly in the liquid phase, connecting the outlet of the condenser to the reservoir and to the inlet of the evaporator, characterized in that it includes a non-return device arranged between the inner chamber of the reservoir and the microporous mass of the evaporator, and arranged to prevent liquid present in the evaporator from moving into the inner chamber of the reservoir, the device being mainly under the influence of gravity, the non-return device including a float returned by buoyancy thrust to a seating in the closed state.

Thanks to these arrangements, liquid is prevented from returning from the evaporator in the direction of the reservoir. In this way, startup under strong thermal load is made more reliable. Moreover, the float is able to let gas bubbles pass through thus avoiding the formation of a gas lock; furthermore, the non-return device is simple and reliable and in addition it can let vapor or gas bubbles pass through.

In various embodiments of the invention, one and/or the other of the following arrangements les optionally be applied:

the float presents a lower density than the density of the fluid in the liquid phase, and comprised between 60% and 90% of the density of the fluid in the liquid phase; whereby the non-return device does not hinder the capillary pumping;

the float is made of stainless steel; such that its durability is extremely good;

the non-return device is arranged in the second fluid communication circuit; such that it can be independent of the reservoir and of the evaporator;

the non-return device is arranged in the lower area of the reservoir; such that it can be combined with the reservoir;

the non-return device is arranged in the upper area of the evaporator; such that it can be combined with the evaporator;

the fluid communication circuit is a tubular conduit; such that its cost is moderate;

the inlet/outlet port is arranged in the lower area of the reservoir, preferably in the lower side area of the reservoir;

the second fluid communication circuit can be in the form of a single conduit with a T coupling or of two independent conduits;

the reservoir includes an input stream deflector near the inlet port; whereby a mixing effect due to the input stream can be avoided;

the reservoir includes a plurality of separate volumes remaining in fluid communication; whereby mixing of the volume of liquid contained in the reservoir is limited;

the reservoir includes a plurality of inner partitions forming compartments adapted to separate said multiple separate volumes;

the plurality of inner partitions forms a compartment structure in the form of a honeycomb; such that the cost-effectiveness ratio is optimised;

the heat transfer device preferentially is deprived of a mechanical pump; such that its reliability is increased;

the device includes in addition an energy-providing element at the reservoir to control the pressurisation of the loop during startup; such that the startup of the loop can be made more reliable.

Figure 3:
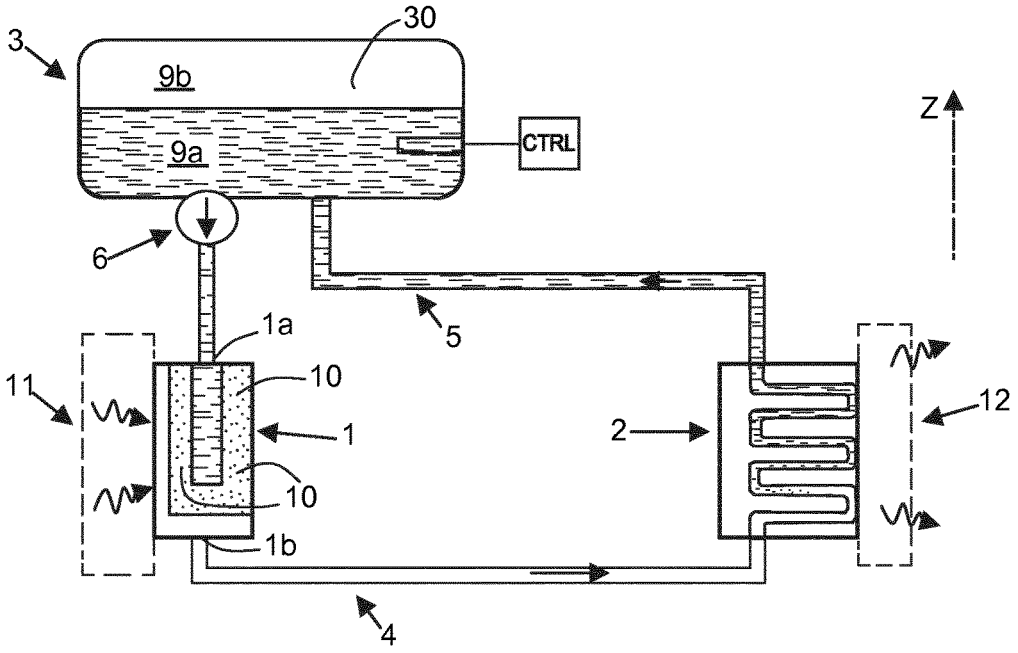
Figure 4A:
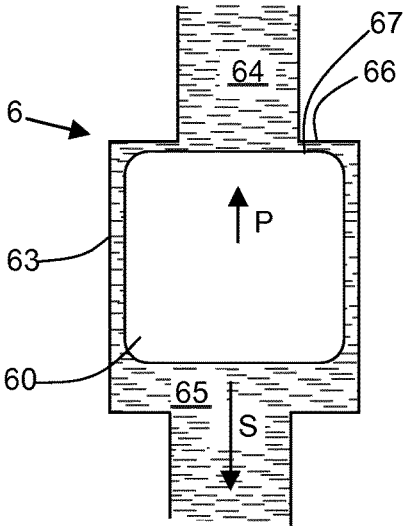
Figure 4B:
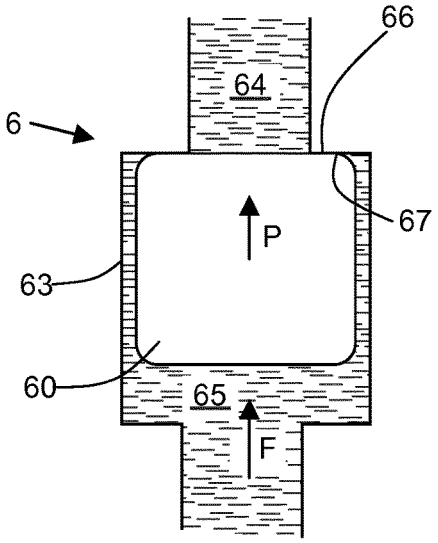
Figure 5:
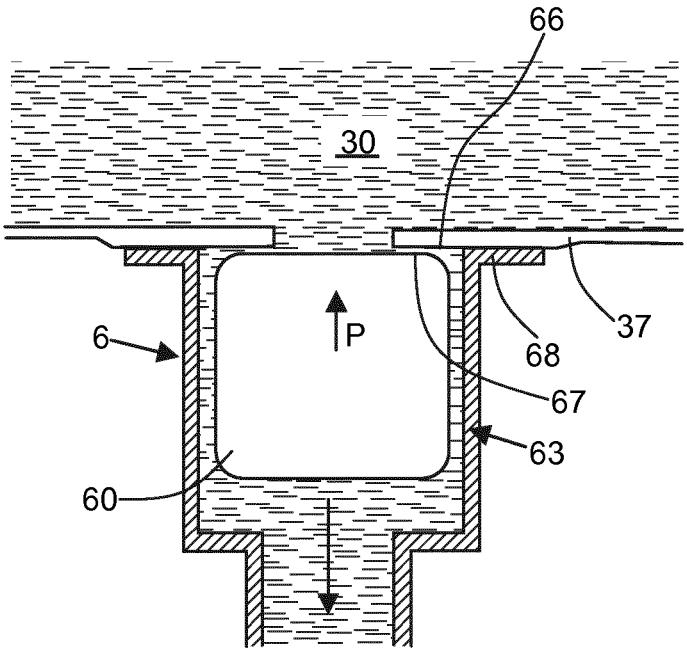
Figure 6:
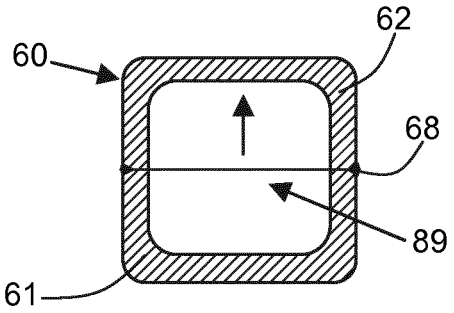
Figure 7A:
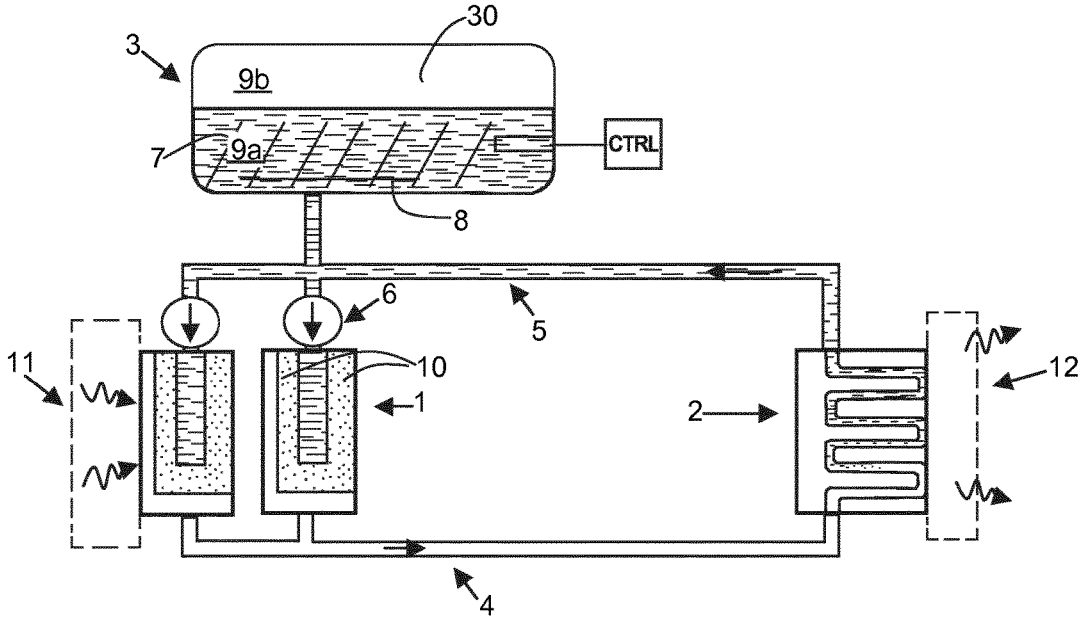
Figure 7B:
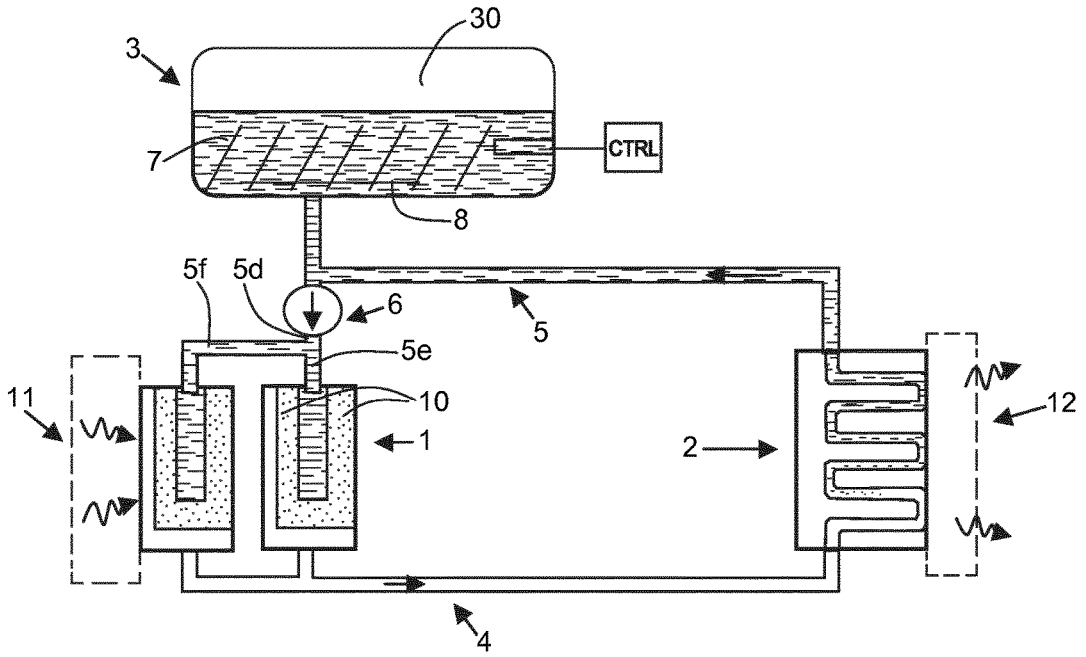

Other aspects, aims and advantages of the invention will become apparent upon reading the following description of several embodiments of the invention, provided as non-limiting examples, with regard to the accompanying drawings in which:

FIG. 1 is a general view of a device according to an embodiment of the invention, FIG. 2 is a variant of the device of FIG. 1, FIG. 3 is another variant of the device of FIG. 1, FIGS. 4*a* and 4*b* show a non-return valve for a device according to FIGS. 1-3, FIG. 5 is a detailed view of the non-return device when it is located at the base of the reservoir, FIG. 6 is a cross-section view of the non-return device;

FIGS. 7*a* and 7*b* show variants of the device of FIG. 1, with several evaporators.

In the different figures, the same references designate identical or similar items.

FIG. 1 shows a capillary-driven heat transfer device, with a two-phase fluid loop. The device includes an evaporator 1, with an inlet 1*a* and an outlet 1*b*, and a microporous mass 10 adapted to perform capillary pumping. For this purpose, the microporous mass 10 surrounds a blind central longitudinal recess 15 communicating with inlet 1*a* in order to receive working fluid 9 in a liquid state from a reservoir 3.

The evaporator 1 is thermally coupled with a heat source 11, such as for example an assembly comprising electronic power components or any other element generating heat, by Joule effect for example, or by any other means.

Under the effect of the supply of calories at the contact 16 of the microporous mass filled with liquid, fluid passes from the liquid state to the vapor state and is evacuated through the transfer chamber 17 and through a first communication circuit 4 which conveys said vapor to a condenser 2 which has an inlet 2*a* and an outlet 2*b*.

In the evaporator 1, the evacuated vapor is replaced by the liquid drawn in by the microporous mass 10 from the aforementioned central recess 15; this is the capillary pumping phenomenon as is well known per se.

Inside said condenser 2, heat is released by the fluid in the vapor phase to a cold source 12, which causes cooling of the vapor fluid and its phase change to the liquid phase, that is to say its condensation.

At condenser 2, the temperature of the working fluid 9 is lowered below its liquid-vapor equilibrium temperature, which is also known as subcooling, such that the fluid cannot revert to the vapor state without a significant heat input.

The vapor pressure pushes the liquid in the direction of outlet 2*b* of the condenser 2 which opens onto a second communication circuit 5, which is also connected to the reservoir 3.

The reservoir exhibits at least one inlet and/or outlet port 31, here in the case of FIG. 1 a separate inlet port 31*a* and outlet port 31*b*, and the reservoir 3 presents an inner chamber 30, filled with the heat transfer fluid 9. The working fluid 9 can be ammonia for example or any other appropriate fluid, but methanol is a preferential choice. The working fluid 9 is a two-phase fluid and is present partly in the liquid phase 9*a* and partly in the vapor phase 9*b*. In an environment where gravity is exerted (vertically according to Z), the gas phase part 9*b* is situated above the liquid phase part 9*a* and a separation surface 19 separates the two phases.

It is the temperature of this separation surface 19 which determines the pressure in the loop, this pressure corresponds to the saturation pressure of the fluid at the temperature prevailing at the separation surface 19.

At the base of the reservoir 34, the temperature of the liquid is generally lower than the temperature prevailing at the separation surface 19.

For correct operation of the capillary-driven loop, it is necessary to avoid a rapid change in the temperature prevailing at the separation surface 19, and to avoid in particular mixing of the liquid phase 9*a* which tends to draw cold liquid from the bottom of the reservoir to the top and therefore make the surface temperature decrease, and with it the pressure also.

The first and second fluid communication circuits 4,5 are preferably tubular conduits, but they could be other types of conduits or fluid communication channels.

Figure 2:
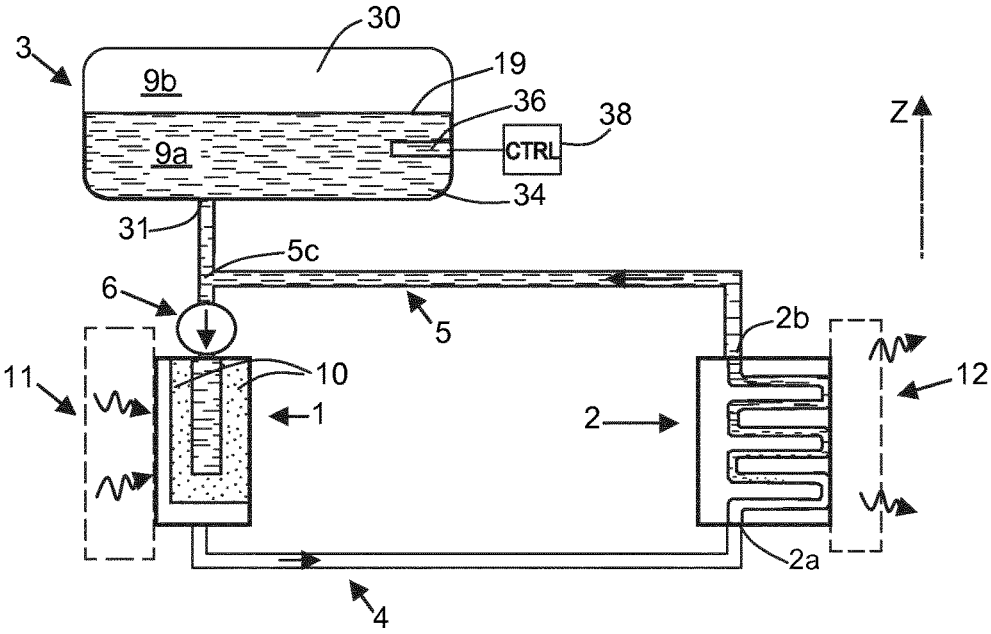

Likewise, the second fluid communication circuit 5 can be in the form of two separate and independent conduits 5*a*,5*b* (cf. FIG. 1) or a single conduit with a T coupling 5*c* (cf. FIG. 2).

In all cases, the second fluid communication circuit 5 connects the condenser outlet 2*b* to the evaporator inlet 1*a*, either indirectly by passing through the reservoir (in the case of two independent conduits) or directly (in the case of a single conduit with a T coupling).

According to the invention, the device includes a non-return device 6, arranged between the inner chamber 30 of the reservoir and the microporous mass 10 of the evaporator 1, to prevent liquid present in the evaporator from moving back into the inner chamber 30 of the reservoir. This non-return device 6 allows to avoid the return of liquid from the evaporator in the direction of the reservoir. An even limited return of liquid from the evaporator in the direction of the reservoir could cause local drying-out of the microporous mass which can lead to depriming of the pumping action of the two-phase loop, which is prevented by said non-return device 6. This phenomenon is all the more pronounced if the power at startup is high (several kW and/or several tens of Watts per $cm^2$). The non-return device 6 thus allows to increase the performance of the system at startup.

The position of said non-return device 6 can be chosen from a number of particularly useful locations depending on the pursued goal and the optimization pursued.

In FIG. 1, the non-return device 6 is positioned on conduit 5*b* connecting the reservoir to the evaporator 1. In this way, the non-return device 6 can be inserted into a two-phase loop where the evaporator and the reservoir are given components that it is difficult to modify.

Furthermore, said non-return device 6 can be positioned, as shown in FIG. 2, adjacent to the evaporator 1, such that said non-return device 6 can be combined with the evaporator, which allows to optimize the footprint the system.

In addition, said non-return device 6 can be positioned, as shown in FIG. 3, adjacent to the reservoir, such that said non-return device 6 can be combined with the reservoir as will be described in detail hereafter, which allows to optimise the footprint of the system.

Preferentially, this non-return device 6 can include a float 60 with a density which is slightly lower than the density of the fluid in the liquid phase, the float coming fully onto a seat in order to close the passage of liquid, as will be explained hereafter.

However this non-return device 6 can also take the more classic form of a non-return valve (not represented in the figures), with a shutter, a valve seat and an elastic return spring tending to push said shutter towards the valve seat. However, the strength of the elastic return spring must only be moderate so as not to counter too strongly the aforementioned capillary pumping force.

When the non-return device 6 is presented as a float, and as shown in FIGS. 4*a* and 4*b*, a unit forming a float 60 is arranged inside a hollow body 63 wherein the float 60 can move at least in a so-called longitudinal direction. The longitudinal direction coincides here with the direction Z wherein buoyant force and gravity are exerted.

In the example shown, the hollow body and the float exhibit rotational symmetry around this Z axis, but this could however be otherwise.

The float comprises an annular bearing surface 67 which comes to press against a corresponding annular seating 66 forming a shoulder directed radially inwards in the hollow body 63. When the float is pressing against the seat 66, the upstream space 64 of the second communication circuit 5 is isolated from the downstream space 65 of the second communication circuit 5, which corresponds to the closed state.

As shown in FIG. 4*a*, when the loop is in established operation, the capillary pumping exerts a suction effect which establishes a slightly lower pressure in the downstream space, and this suction effect S draws the float downwards. The passage of liquid at the level of the seat 66 is then open and liquid can flow from upstream 64 to downstream 65.

It should be noted that, if non-condensable vapor or gas bubbles are found in said liquid in the downstream part 65, they can escape in the opposite direction (from downstream to upstream) which allows to avoid blocking the feeding of the evaporator with fresh liquid: the float is therefore able to let gas bubbles pass and thus avoid the formation of a gas lock, this function can also be called a degassing function.

According to an advantageous aspect of the invention, the float exhibits a lower density than the density of the fluid in the liquid phase, and comprised between 60% and 90% of the density of the fluid in the liquid phase (at a maximum temperature in the order of 100° C. for example). In this way, the resultant of the weight and of the buoyant force give a pushing force P directed upwards.

The intensity of this pushing force P must however be moderated to be lower than the suction effect of the aforementioned capillary pumping action.

In a transitional configuration, in particular during an initial startup or in the case of a sudden increase in the thermal load to be evacuated, a sudden increase in the generation of vapor in the evaporator tends to push the liquid contained in the cavity 15 back in the direction of the reservoir. This must be avoided in order to prevent drying-out of the microporous mass (also known as wick) which would deprime the loop.

As shown in FIG. 4*b*, in the event of liquid flowing from the cavity 15 of the evaporator, a pressure force F directed upwards has the effect of pushing the float 60 fully against the seating 66 and of thus closing the passage of liquid. Consequently, any reflux of liquid in the direction of the interior 30 of the reservoir is avoided.

In a particularly advantageous configuration where the non-return device 6 is arranged in the lower area of the reservoir, the non-return device 6 is arranged in the base of the reservoir, at the level of the outlet port 31*b* (cf. FIGS. 3 and 5). In this case, the body 63 includes a collar 68 which is solidly fixed to the base 37 of the reservoir by well-known attachment means. Moreover, the base 37 at the level of the port 31*b* can be used directly as a shutting seat 66.

According to the invention, the float can be made of stainless steel such that its durability is extremely good. As shown in FIG. 6, the float 60 can be made in the form of two half-shells 61,62 welded to each other at the level of a diameter by means of a weld 68; the two half-shells 61,62 thus define an inner chamber 89 filled with preferably inert air or gaz. The thickness of the walls of the two half-shells 61,62 as well as the size of the inner chamber 89 are chosen to obtain the desired density for the overall float assembly 60.

In addition, with a view to avoiding mixing phenomena inside the reservoir which are conducive to the cold shock phenomenon, there can be provided inside the reservoir, and as shown in FIGS. 7*a*-7*b*, multiple separate volumes separated from each other, said separate volumes remaining in fluid communication. In particular, and more precisely, in the reservoir there can be arranged a plurality of inner partitions 7 configured in order to separate said multiple separate volumes.

Moreover, advantageously according to the invention, the reservoir can include an input stream deflector 8 near the inlet port 31*a* or the inlet/outlet port 31 depending on the configuration of the second conduit.

This input stream deflector 8 prevents a rapid surge of liquid in the reservoir from creating a bubbling phenomenom or a stream current likely to favour mixing of the liquid. It can exhibit the form of a U section oriented downwards, or of a bowl or of any other shape creating a sufficient deviation of the trajectory of the input stream.

The compartment structure 71 can present vertical partitions 7, i.e. oriented in the direction of gravity. It should be noted however that the partitions can just as well be slightly or substantially inclined, as illustrated for example in FIG. 7*a*.

Advantageously, it is possible to choose a honeycomb structure with a hexagonal mesh.

It should be noted that the reservoir can have any shape, and in particular be parallelepiped or cylindrical. Moreover, the compartment structure can be made of stainless steel.

According to one aspect of the present invention, said multiple separate volumes communicate through passages with a small cross-section, preferably less than 1/10 of the largest cross-section du reservoir.

According to another advantageous aspect of the invention, the compartment structure can comprise a phase change material providing thermal inertia to said structure which helps to limit abrupt temperature variations.

FIGS. 7*a* and 7*b* show that it is possible in the context of the present invention to have several evaporators 1 in parallel with each other to increase their capacity to evacuate calories and/or to position the evaporators as closely as possible to the heat sources.

According to the configuration in FIG. 7*a*, each evaporator has a non-return device 6 in its specific liquid supply circuit, whereas according to the configuration in FIG. 7*b*, the non-return device 6 is positioned in the shared branch 5*d* upstream from the distribution 5*e*,5*f* to the evaporators, which allows to mutualise the non-return device 6 and thus optimise the cost of a system with several evaporators.

Furthermore, the device may further include an energy-providing element 36, for example a heating element or a pressuriser element, located at the reservoir to control the pressurisation of the loop during startup. A "Ctrl" control system 38 manages, in the case of a heating element, the supply of calories on this heating element 36, according to temperature information and/or pressure information delivered by sensors (not shown), this being in order to ensure startup of the two-phase loop. Moreover, this "Ctrl" control system can also prepare the two-phase loop for an imminent and significant arrival of calories on the evaporator, which allows to anticipate the reaction of the two-phase loop with regard to the need for thermal dissipation. Sizing of the loop can thus be optimised for large amounts of heat to be evacuated.

Advantageously according to the invention, the device does not require the use of a mechanical pump even though the invention does not exclude the presence of an auxiliary mechanical pump.

The invention claimed is:

1. A capillary-driven heat transfer device, adapted to extract heat from a heat source and to release this heat to a cold source by means of a two-phase working fluid contained in a closed general circuit, comprising:

an evaporator, having an inlet and an outlet, and a microporous mass adapted to perform capillary pumping of fluid in the liquid phase a condenser having an inlet and an outlet, a reservoir having an inner chamber, and at least one inlet and/or outlet port, a first communication circuit for fluid mainly in the vapor phase, connecting the outlet of the evaporator to the inlet of the condenser, a second communication circuit for fluid mainly in the liquid phase, connecting the outlet of the condenser to the reservoir and to the inlet of the evaporator, a non-return device arranged between the inner chamber of the reservoir and the microporous mass of the evaporator, and arranged to prevent liquid present in the evaporator from moving back to the inner chamber of the reservoir, the device being mainly under the influence of gravity, the non-return device including a float returned by buoyancy thrust to an annular seat in the closed state, wherein:

the seat is annular and the float is formed as a solid body having an annular bearing surface configured to come in tight contact with the annular seat to close the passage when the float is returned by buoyancy thrust to an annular seat;

the float is surrounded by liquid; and the float is arranged to be drawn downwards to an open state by a suction effect, caused by the evaporator, to let the liquid go downwards.

2. A device according to claim 1, wherein the float exhibits a density comprised between 60% and 90% of a density of the fluid in the liquid phase.

3. A device according to claim 1, wherein the float is made of stainless steel.

4. A device according to claim 1, wherein the non-return device is arranged in a lower area of the reservoir.

5. A device according to claim 1, wherein the non-return device is arranged in an upper area of the evaporator.

6. A device according to claim 1, wherein the at least one inlet and/or outlet port includes an inlet port and the reservoir includes an input stream deflector near the inlet port of the reservoir.

7. A device according to claim 1, wherein the reservoir includes multiple separate volumes, said separate volumes remaining in fluid communication.

8. A device according to claim 7, including a plurality of inner partitions forming compartments that separate said multiple separate volumes from each other.

9. A heat transfer device according to claim 1, wherein it is deprived of a mechanical pump.

10. A device according to claim 1, wherein the evaporator, condenser, reservoir, first communication circuit, second communication circuit, and non-return device are part of a loop, the device additionally including an energy-providing element at the reservoir to control pressurisation of the loop during startup.

* * * * *